US008460054B2

(12) United States Patent
Swendseid

(10) Patent No.: US 8,460,054 B2
(45) Date of Patent: Jun. 11, 2013

(54) EXERCISE GARMENT

(75) Inventor: Jennifer V. Swendseid, St Louis Park, MN (US)

(73) Assignee: Heart&Core LLC, St. Louis Park, MN (US)

( * ) Notice: Subject to any disclaimer, the term of this patent is extended or adjusted under 35 U.S.C. 154(b) by 0 days.

(21) Appl. No.: 13/461,982

(22) Filed: May 2, 2012

(65) Prior Publication Data

US 2012/0220192 A1 Aug. 30, 2012

Related U.S. Application Data

(63) Continuation of application No. 12/688,582, filed on Jan. 15, 2010, now Pat. No. 8,172,639.

(51) Int. Cl.
*A41C 3/00* (2006.01)

(52) U.S. Cl.
USPC ..... 450/18; 450/5; 450/25

(58) Field of Classification Search
USPC ..... 450/5, 18, 25, 73, 79, 77, 85, 86, 450/30–33
See application file for complete search history.

(56) References Cited

U.S. PATENT DOCUMENTS

| | | | | |
|---|---|---|---|---|
| 3,362,409 | A | | 1/1968 | Bruno |
| 4,289,137 | A | | 9/1981 | Dell et al. |
| 4,432,364 | A | | 2/1984 | Martini |
| 4,583,544 | A | | 4/1986 | Flanagan et al. |
| 4,781,651 | A | * | 11/1988 | Ekins ..... 450/79 |
| 4,816,005 | A | | 3/1989 | Braaten |
| 4,909,771 | A | | 3/1990 | Bergman |
| 5,211,598 | A | | 5/1993 | Hall |
| 5,823,851 | A | | 10/1998 | Dicker |
| 5,967,877 | A | | 10/1999 | Howard |
| 6,068,538 | A | | 5/2000 | Alleyne |
| 6,165,045 | A | | 12/2000 | Miller et al. |
| D438,691 | S | | 3/2001 | Zagame |
| 6,514,120 | B1 | | 2/2003 | Hass |
| 6,572,437 | B1 | | 6/2003 | Waitz |
| 7,089,597 | B2 | | 8/2006 | Horii et al. |

(Continued)

FOREIGN PATENT DOCUMENTS

| | | |
|---|---|---|
| AU | 2007203134 | 1/2008 |
| JP | 2003-221705 | 8/2003 |
| WO | 2010/102348 | 9/2010 |

OTHER PUBLICATIONS

International Search Report for PCT Application No. AU2010/000290 mailed Apr. 23, 2010, 4 pgs.

(Continued)

*Primary Examiner* — Gloria Hale
(74) *Attorney, Agent, or Firm* — Patti J. Jurkovich; Billion & Armitage

(57) ABSTRACT

An exercise garment includes front and rear panels with height adjusting straps that extend over the wearer's shoulders. The front panel includes an outer compression fabric and an inner cup assembly, which is essentially non-compressive. The cup assembly includes individual cups for each breast, which can each include an under support. An elastic band extends around the bottom portion of the garment. Tensioning structures, such as side flaps extending from the back to the front, can be provided to adjust the circumferential size of the garment. The garment can include releasable connectors on the side of the garment to at least partially release the compressive tension to aid in putting on and taking off the garment.

27 Claims, 12 Drawing Sheets

U.S. PATENT DOCUMENTS

| | | | | |
|---|---|---|---|---|
| 7,207,861 | B2 | 4/2007 | Martini | |
| 7,309,276 | B2 | 12/2007 | Legaspi et al. | |
| 7,381,113 | B2 | 6/2008 | Hori | |
| D594,631 | S | 6/2009 | Reinisch | |
| 7,909,675 | B1 | 3/2011 | Rainey | |
| D635,329 | S | 4/2011 | Wahl et al. | |
| 2001/0019933 | A1 | 9/2001 | Wagner | |
| 2006/0048547 | A1 | 3/2006 | Duckham et al. | |
| 2006/0252346 | A1 * | 11/2006 | Reinisch et al. | 450/86 |

OTHER PUBLICATIONS

Heart&Core, LLC; Signature Line Sports Bras; www.heartandcare.com/Sports_Bras.html; Dec. 2009; 1 pg.

Casselman; The Physics of Bras: Overcoming Newton's Second Law With Better Bra Technology; Discover Magazine; http://discovermagazine.com/2005/nov/physics-of-bras/article_print; Nov. 22, 2005; 3 pgs.

Berlei; Getting Fitted Is Just as Important as Getting Fit!; http://www.berlei.com.au/news/newsitem.aspx?id=24; Feb. 12, 2010; 1 pg.

McGhee et al.; Breast Elevation and Compression Decreases Exercise-Induced Breast Discomfort; Medicine & Science, Sports & Exercise: The Official Journal of the American College of Sports Medicine; Nov. 9, 2009; 22 pgs.

Mills; The Intelligent Bra That Takes the Jiggling Out of Jogging; Mail Online; http://www.dailymail.co.uk/sciencetech/article-500874; Dec. 9, 2007; 6 pgs.

Autospeed; Designing the Perfect Bra; http://autospeed.com/A_1260/cms/article.html; Jan. 22, 2002; 5 pgs.

Tomima; (Un)covering What's Under Everything: More Study on Breast Movement and Breast Pain; http://www.tomima.com/2009/12/09/more-study-on-breast-movement-and-breast-pain/; Dec. 2009; 5 pgs.

Good Read; Quest to Make the Perfect Fit Bra; http://spoonfeedin.blogspot.com/2008/06/quest-to-make-perfect-fit-bra.html; Jun. 24, 2008; 7 pgs.

Lawson et al.; Selected Sports Bras: Comparisons of Comfort and Support; Clothing and Textiles Research Journal; http://ctr.sagepub.com/cgi/content/abstract/8/4/55; 1990, 1 pg.

ABC Science Online; Smart Bra to Give Support When It's Needed; http://www.abc.net.au/science/news/stories/s131388.htm; May 26, 2000; 2 pgs.

Starr et al.; Biomechanical Analysis of a Prototype Sports Bra; Journal of Textile and Apparel, Technology and Management, vol. 4, Issue 3; Spring 2005; 14 pgs.

* cited by examiner

EXERCISE GARMENT

RELATED APPLICATION

This application is a continuation application of U.S. patent application Ser. No. 12/688,582, filed Jan. 15, 2010, which is incorporated herein by reference.

FIELD

This application relates generally to an exercise garment, and, more specifically, to exercise apparel, undergarment, and a brassiere.

BACKGROUND

Women wear sports brassieres (bras) to support their breasts and reduce the bounce that can be experienced during exercise for comfort. Research has shown that ill fitting bras, commonly worn by many women, can result in damage to the fragile ligaments, which can be irreparably stretched, broken collar bones from sudden movement, and possibly nerve damage. These issues can be of even greater importance to larger chested women. If a woman experiences pain or discomfort during exercise, she may decide to stop exercising, which may be detrimental to her overall health. The present inventor has determined that this can be a more significant problem, which has not been adequately addressed by current sports bras.

BRIEF DESCRIPTION OF DRAWINGS

Example embodiments are illustrated by way of example and not limitation in the figures of the accompanying drawings, in which like references indicate similar elements and in which.

DETAILED DESCRIPTION

Figure 1A:
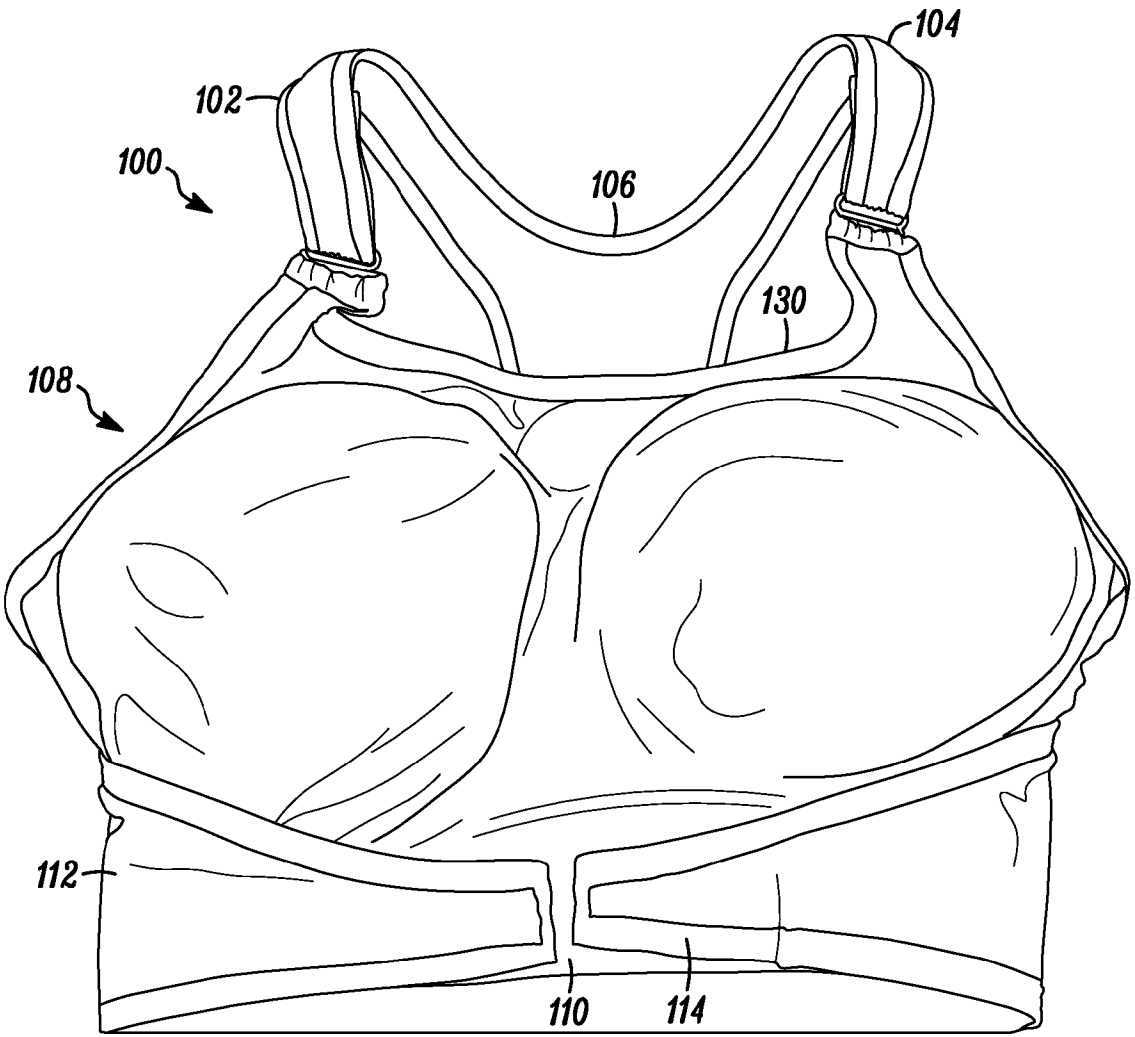
FIG. 1A is a front view of the exercise garment in accordance with an example embodiment.

In an example embodiment, an exercise garment includes a rear panel and a front panel connected to the rear panel. The front panel includes an elastic, outer cover fabric and a cup assembly to receive the breasts of the wearer. The cup assembly defines two cups that are joined by a bridge. The cup assembly encapsulates the wearer's breasts in an essentially non-stretchable fabric. The cover fabric can be elastic and can compress against the cup assembly to secure the wearer's breasts in place during exercise. An elastic band is positioned beneath the cup assembly to secure the garment on the torso of the wearer. Shoulder straps extend from the front panel to the rear panel. The garment further includes a circumferential tightening structure to tighten the circumference of the garment around the torso of the user. The circumferential tightening structure can engage the front of elastic band or the front panel to pull the front and rear panels together to tighten the garment or reduce the circumferential size of the garment.

The shoulder straps can be adjustable in length to position the front panel vertically. To be adjustable the shoulder straps are cantilevered (e.g., fixed to the rear panel) from the rear panel and releasably connect to the front panel. The free ends of both the shoulder straps can lie over a portion of the respective first strap and second strap and secure thereto.

In an example, the circumferential tightening structure includes at least one side flap that in a first, free position is connected to only one of the front panel and the rear panel and in a second, tensioning position has another end that connects to the other of the front panel and rear panel. Flaps can be positioned on both sides of the garment. The rear sides of the flaps can be fixedly connected to the rear panel and extend essentially the height of the rear panel. The flaps can include a narrower end that is adapted to wrap around to the front panel and engage at least one of the front panel and the band to tension the garment around the torso of the wearer.

The band is positioned on the bottom of the garment and can have one part of a hook and loop connector. The flaps can include the other part of a hook and loop connector such that hook and loop connector releasably joins the flaps to the front of the band. The connector can release tension between the front panel and rear panel to assist in removing the garment from the wearer.

The garment can be a shirt that has an extension connected to the front and rear panel. The shirt extension can extend downwardly to cover a lower part of a torso of a wearer.

In an example, the cups can each include an under support to assist in lifting the wearer's breasts. In an example, the under support includes a foam material.

In an example, a zipper or other removable connector can be positioned on a side of the garment, e.g., between the front and rear panels or adjacent the front or rear panel. The zipper can assist in securing the garment and releasing the same after exercise.

Any of the preceding paragraphs in this section can be combined with each other.

The following detailed description includes references to the accompanying drawings, which form a part of the detailed description. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and electrical changes can be made without departing from the scope of what is claimed. The following detailed description is, therefore, not to be taken in a limiting sense, and the scope is defined by the appended claims and their equivalents.

In this document, the terms "a" or "an" are used, as is common in patent documents, to include one or more than one. In this document, the term "or" is used to refer to a nonexclusive "or," such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

FIG. 1A shows an exercise garment 100 that includes a right shoulder strap 102 and a left shoulder strap 104 extending from a back panel 106 to a front panel 108. The shoulder straps 102, 104 are adapted to extend over a wearer's shoulders to support and to properly position the garment 100 on the wearer. The shoulder straps 102, 104 are adjustable to position the garment, specifically, the front panel 108, in the vertical direction. The back and front panels 106, 108 are connected to each other to form a continuous covering around the wearer's torso. The front panel 108 is to support the breasts of the wearer in a secure manner during exercise. The front panel 108 includes a formed inner portion, which forms two cups to support a woman's breasts, and an outer portion, which can provide compression to secure the woman's breasts in place. These two portions will be explained in greater detail herein. The back panel 106 is racer back style such that the rear panel is significantly smaller than the front panel 108. When correctly worn by a wearer, the back panel 106 is centered on the mid-sagittal plane of the wearer's body with the bulk of the rear panel resting between the shoulder blades of the wearer. The back panel 106 is to provide support to the front panel 108 and keep the front panel in the proper position for breast support. The front and back panels 108, 106 are connected, e.g., sewn, heat welded or otherwise fixed to each other on sides, e.g., below the arms of the wearer. An elasticized band 110 is fixed to the bottom edge of both the front panel 108 and the rear panel 106. The band 110 can be integrally sewn in the body of the panels 106, 108. A left side flap 112 is connected to and cantilevered from a left side of the garment 100 and extends around at least part of the front panel 108 to provide an individual fit for the wearer. A right side flap 114 is connected to and cantilevered from a right side of the garment 100 and extends around at least part of the front panel 108 to provide an individual fit for the wearer. Each of the flaps 112, 114 extend less than half the width of the front panel. The flaps 112, 114 pull the rear and front panels 106, 108 together to reduce the horizontal (here, circumferential) size of the garment.

Figure 1B:
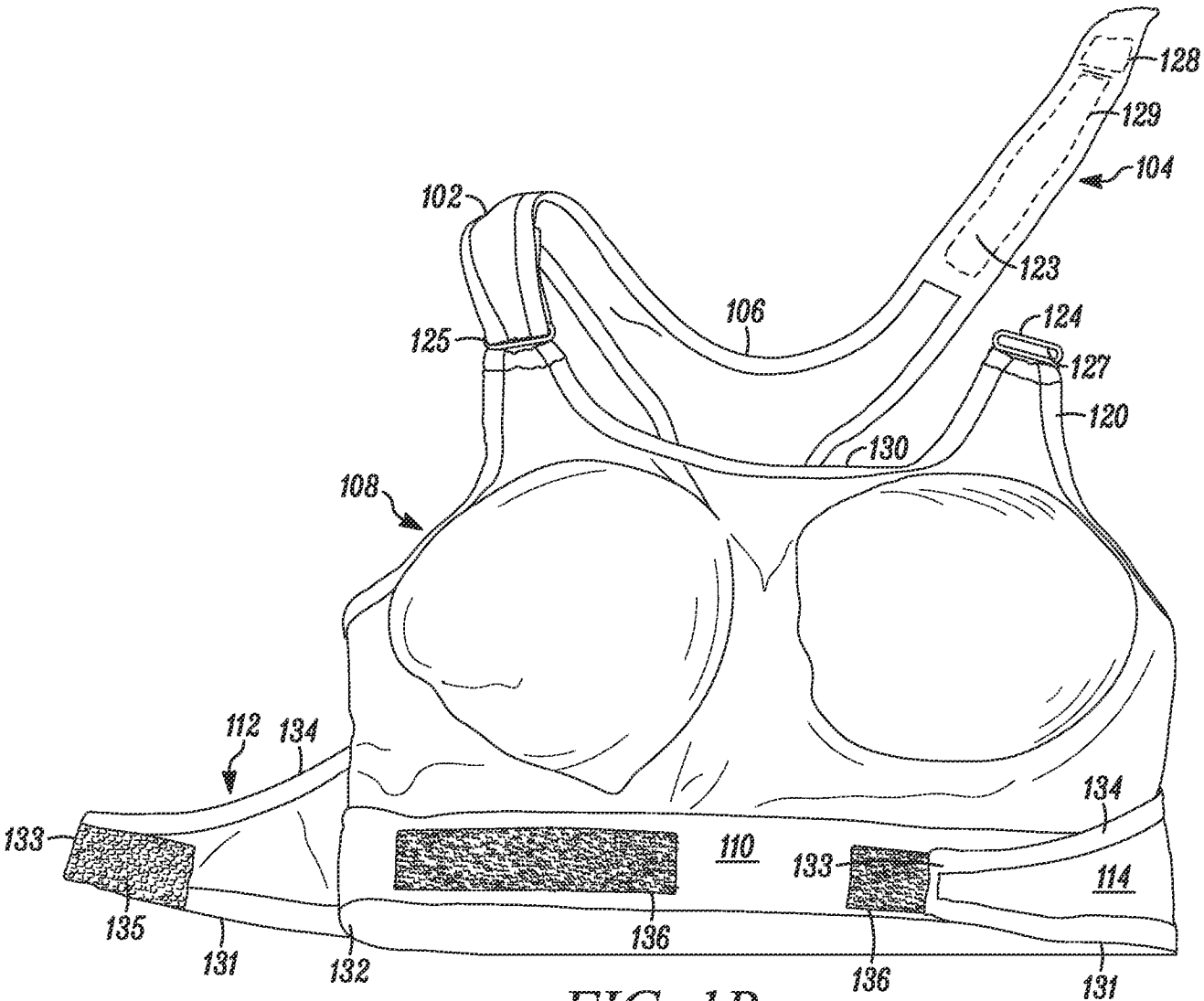
FIG. 1B is a front view of the exercise garment in accordance with an example embodiment.

FIG. 1B shows a front view of the garment 100 with the shoulder strap 104 released from the connector 124 to show the details of the strap 104. It will be recognized the other strap 102 can be the same as strap 104 but a mirror image to comfortably fit on the other side of the wearer's body. Connector 124 includes two elongate apertures. The apertures have two opposed linear sides that receive fabric therein. A front panel aperture is fixed to a left upward extension 126 of the front panel 108. A strap aperture 127 is to receive the free end of the cantilevered strap 104 therein. A same connector 125 connects to the front panel 108 to the right strap 102. Strap 104 includes a hook and loop connector affixed thereto. An example of a hook and loop connector is VELCRO™. The hook part 128 of the connector is affixed to the free end of the strap 104. In an example, the hook part 128 covers substantially the width of the strap 104. The hook part 128 can have a length of about one inch or less. The loop part 129 of connector extends the width of the strap 104 and extends a significant length of the strap 104. The loop part 129 can extend about 6 inches or less. The hook part 128 and the loop part 129 are positioned on the same side of the strap 104. In use, the free end of the strap 104 is inserted through the upper, free, strap aperture 127 and pulled upward to align the hook part 128 with the loop part 129 by folding the strap back onto itself. In an example, the strap 104 folds over the front of connector 124 and threads through the aperture 127 from the front to the back. The end of the strap that is through the aperture 127 folds upwardly under the remaining part strap. This can provide a smooth outward appearance to the strap 104 with the free end of the strap 104 tucked under the strap 104. The hook and loop parts are mated together to fix the length of the strap 104. The hook part 128 can be removed from the loop part 129 to adjust the length of the strap 104 so that the front panel is properly aligned for the individual wearing the garment. As a result the front panel 108 can be positioned properly for the individual's body shape in the vertical direction. The two upward extensions on the front panel 108 and the main body form a neckline 130 that is below the top of the back panel and below the neck of the wearer for comfort during exercise.

Shoulder straps 102, 104 can have two configurations. The first configuration is shown as strap 102. The second configuration is shown as strap 104. While shown as two different configurations, it will be understood that the straps 102, 104 can be the same configuration for any individual garment 100. The first and second straps 102, 104 are an elastic fabric, however, the elastic will not stretch to such an extent that the strap allows the front panel to sag. The free end of the strap 104 is threaded under the connector 124 and threaded forwardly through aperture 127 and then folded back on itself. The hook and loop connector includes a first part on the forward face of the strap 104 for this type of connection. The folded over part of the strap 104 then on the top of strap part on the wearer's shoulder and not in contact with the wearer's shoulder. However, the strap 104 is shown in FIG. 1B with the connector parts 128 and 129 in the free end, tuck under configuration. The connector parts 128 and 129 would be on the back (nonvisible side in FIG. 1B) of the strap 104 in the free end on top of the strap configuration. In the free end on top configuration of strap 104, the free end of the strap 104 is easily accessed by the wearer and adjustments can easily be made while wearing the garment 100, even while exercising. A cushioning pad 123 can be positioned on each of the straps 102, 104 on the face of the strap whereat the strap comes into contact with the wearer's shoulder. In the strap 104's configuration with the free end of the strap folded over the top of the remaining portion of the strap, the free end will not block part of the cushion 123. Accordingly, the cushion 123 provides a cushion with the body of the wearer over its entire length.

Also shown in FIG. 1B is the right flap 112 in an unconnected position, i.e., it is not affixed to the band 110. The left flap 114 is affixed to the band 110. It will be understood that the flaps 112, 114 can be the same and mirror images of each other on opposite sides of the garment. The flap 112 has a trapezoid shape with a bottom side 131 that is substantially parallel with the bottom side of the band 110. The vertical sides 132, 133 being essentially perpendicular to the bottom side 131. The top side 134 slopes downwardly to the front vertical side 133. In the free position, the flap 112 is only connected to the rear panel 108 at the rear side 132. The rear side 132 has a height that is equal to the height of the rear panel 108 whereat the flap 112 is connected to the rear panel. In another example, the flap 112 is connected to the seam whereat the front panel 108 and the rear panel 106 are connected. In another example, the rear side 133 has a height less than the height of the rear panel 106 at the location whereat the rear side 133 is connected. The rear side 133 will have a height greater than half the height of the rear panel 106, where connected. A connector releasably connects the flap 112 to the band. The connector can be a hook and loop connector. The hook part 135 is fixed to the inner side of the flap 112 adjacent the front side 132. The loop part 136 is fixed to the front face of the band 110. In an example, the hook part 135 and loop part 136 each have a height of about half inch. The hook part 135 has a length of about one and half inch. The loop part 136 can extend across the entire front length of the band 110. In another example, the loop part 136 extends about one-third the length of the band 110. In another example, a break in the loop part 136 is located at the midpoint of the band 110. In use, the wearer grips the flap 112 and pulls the free front end side 133 to align the hook part 135 with the loop part 136. The wearer stretches the flap 112 to create a tension in the fabric of the flap and then fixes the hook and loop parts 135, 136 to connect the free end of the flap to the band 110. The shape of flap 112 distributes the tension from the front side end of the flap to the entire height of the rear panel while pulling the band 110 tighter about the torso of the wearer. Any excess material of at least one of the front panel 108, rear panel 106, and/or band 110 under the flap 112 can fold comfortably at the sides of the wearer. As a result the circumferential size of the band 110 and the garment 100 as a whole can be adjusted to fit the wearer's torso and the comfort level of the wearer. The circumferential size and tension of the garment 100 are adjustable such that the garment can be individualized for any wearer.

Figure 2:
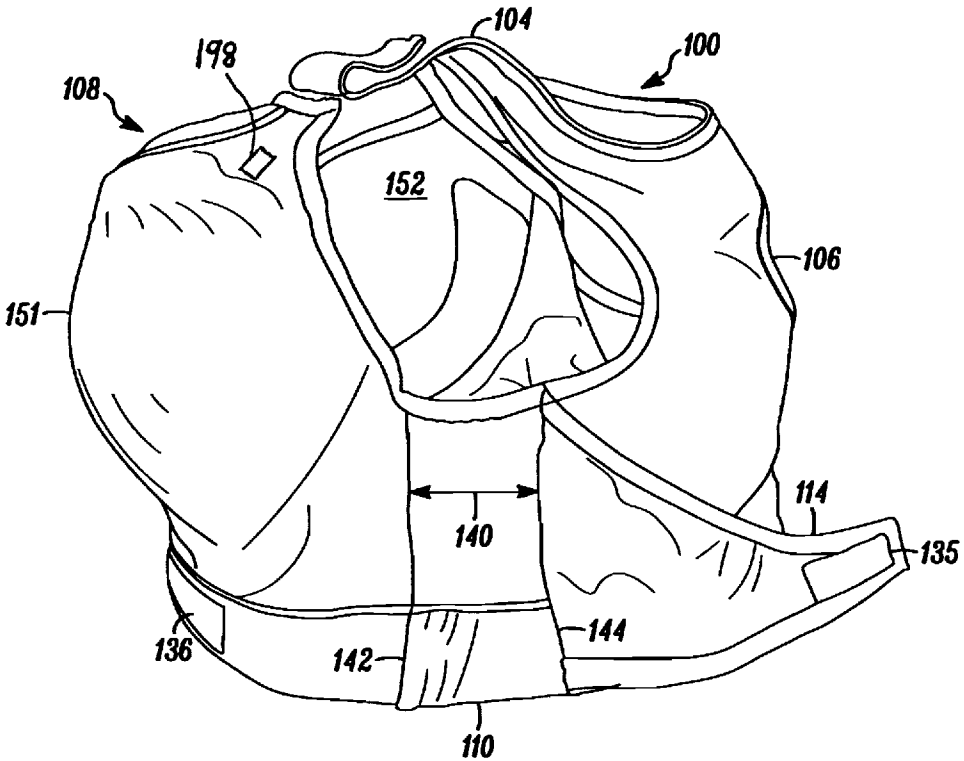
FIG. 2 is a side view of the exercise garment in accordance with an example embodiment.

FIG. 2 shows a side view of the garment 100 with the flap 114 free from connection to the front of the band 110 to show the side portion 140 of the garment 100 that can be pulled together to reduce the circumference of the garment 100. The width of the side portion 140 is measured from the seam 142, where the back panel 106 is connected to the front panel 108, and the seam 144, where the flap is fixed to the rear panel 106. It will be further recognized that the loop part 136 extends far enough to the other side that the flap 114 can move its seam 144 to seam 142 with the hook part 135 fully engage the loop part 136 on the front of the band 110.

The front panel 108 includes a fabric cover 151 that extends the entire size of the front panel. Fabric cover 151 is at least one layer of a stretchable, vertically and horizontally, fabric that can provide tension and compression to the front of the wearer. The stretchable fabric can be a knit material that can include LYCRA™, spandex, or other synthetic stretchable polymer. In an example, the resilient stretchable material is up to 10% of the content of the fabric. Other wicking material can be used in the fabric cover, e.g., COOLMAX™. Cover 151 extends the entire extent of the front panel and it connects to the rear panel 106. Cup assembly 152 is positioned beneath the cover 151 and is partially visible in FIG. 2. The cup assembly 152 is not visible in FIGS. 1A and 1B as the cover 151 completely covers the cup assembly 152 but the cup assembly 153 is form holding (e.g., semi-rigid). Hence, the cup assembly 152 gives a shape to the front panel 108 which would not exist due to the fabric cover alone. The cup assembly 152 defines two distinct cups 153, 154 (see, FIGS. 3 and 4 for a better view of the cups) for receiving the breasts of a wearer. The cup assembly 152 can support and secure the breasts in place, particularly when the wearer as a larger cup size, and can help reduce the single breast look when both breasts are compressed in a traditional sports bra. The two individual cups 153, 154 can individually encapsulate the wearer's breasts.

Figure 3:
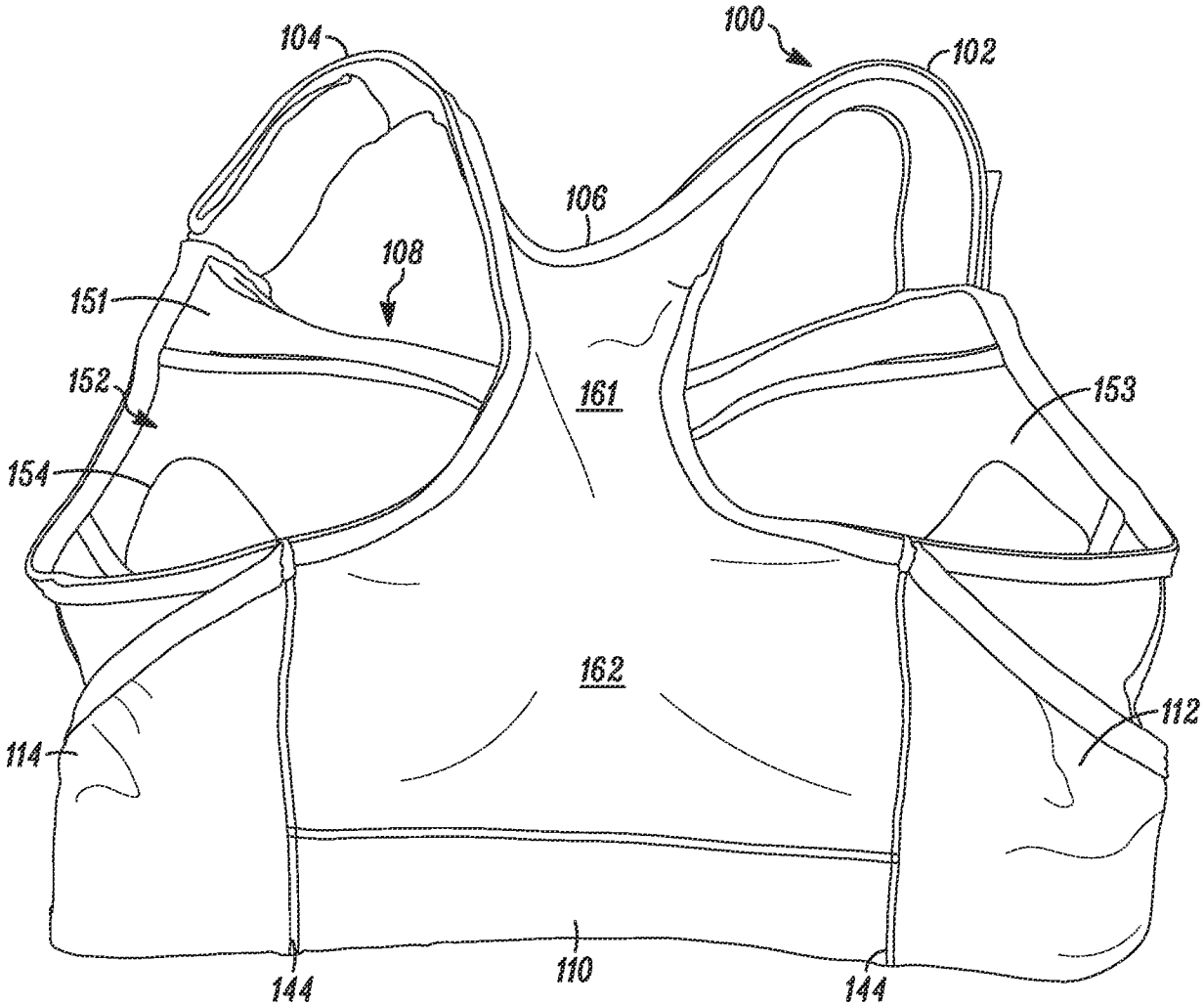
FIG. 3 is a rear view of the exercise garment in accordance with an example embodiment.

FIG. 3 shows a rear view of the garment 100 including the rear band portion 110B, which can have a stronger elastic strength than the remainder of the band. The rear panel 106 includes a narrow upper portion 161 that can seamlessly transition into the straps 104, 106. Upper portion 161 is sized such that it essentially lays between the scapulae of the wearer and not interfere or chaff the user during exercise. The rear panel 106 includes a lower portion 162, which can be an integral fabric with the upper portion 161. The lower portion 162 has a height that extends from essentially beneath the wearer's scapulae and to essentially beneath the circumferential line beneath the wearer's breasts. Accordingly, the shape of the upper portion 161, the lower portion 162, straps 102, 104, and the top part of the front panel 108 to not interfere with freedom of movement of the arms and shoulders of the wearer.

Figure 4:
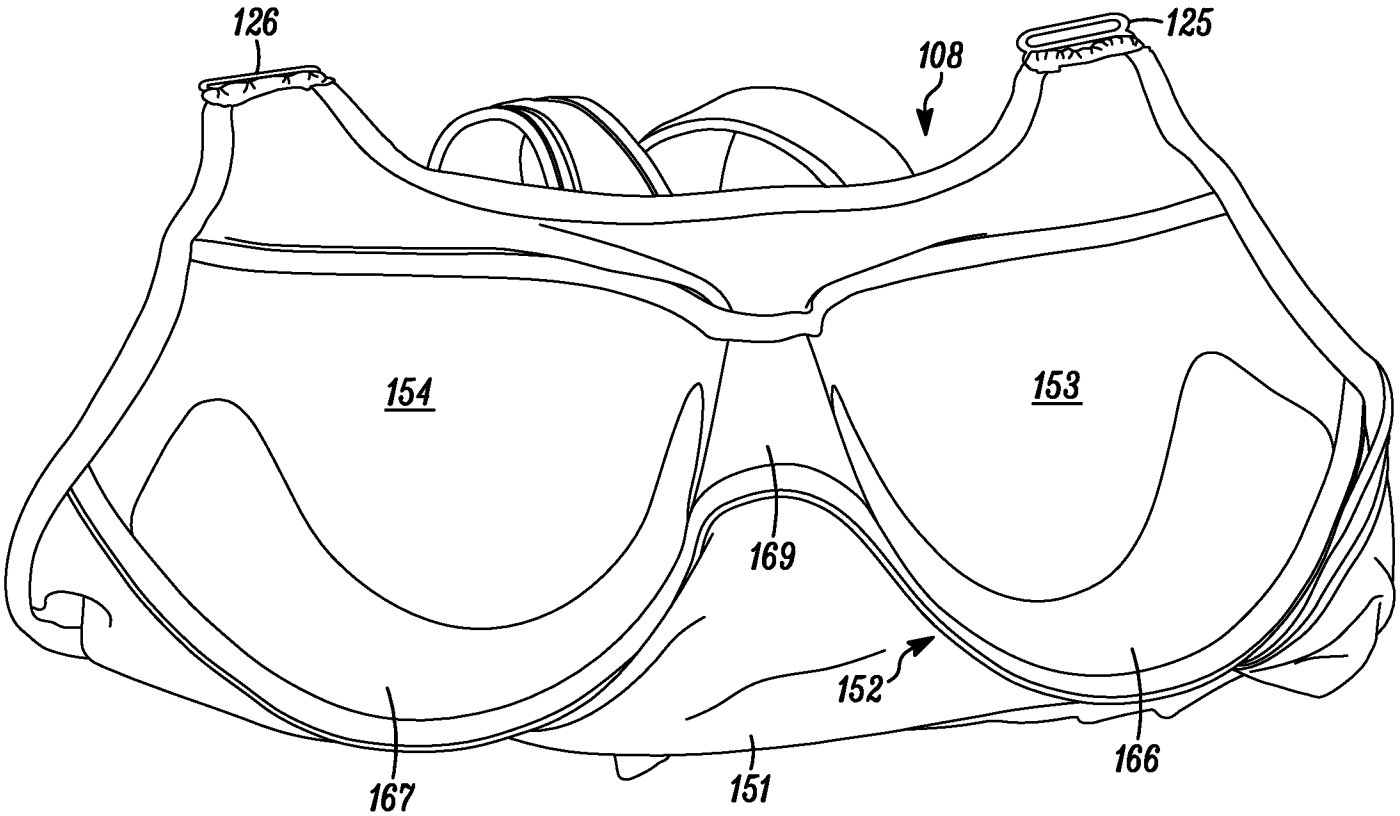
FIG. 4 is an interior view of the front of the exercise garment in accordance with an example embodiment.

FIG. 4 shows a rear view of the front panel 108 including the cover 151 and the cup assembly 152, i.e., the rear panel is removed to more clearly show the cup assembly 152. The right and left cups 153 and 154 can be sized to fit a woman's breast size and individually encapsulate a wearer's breast. Thus, the inventor's of the present invention have found that a cup, e.g., A, B, C, D, DD, etc. that matches a wearer's breast size with a compressive cover, i.e., 151, provides a more comfortable fit and secures the breasts during exercise. However, larger cup sizes may require more support. An under support 166, 167 is positioned along the bottom arcuate side of the cups 153, 154, respectively. The under support 166, 167 is positioned such that it extends under the wearer's breasts to provide further support. In an example, the under support 166 or 167 is a foam insert within the respective cup. The foam can have a density. In an example, the under supports 166, 167 are a gel with the cup. In an example, the under supports 166, 167 are a pliable polymer material that provides support without causing pressure points on the wearer. In a further example, the under support 166, 167 can be an underwire if the underwire is coated or covered such that it does not provide pressure points on the wearer. The foam insert under support 166, 167 create a thicker portion of the respective cup that the remainder of the cup. The under support extends inwardly into the concave portion of the cup such the outer portion of the cup is smooth to provide an attractive, smooth appearance for the wearer.

The cup assembly 152 includes a bridge 169 is positioned between the cups 153, 154. The bridge 169 has the less height as compared to the remainder of the cup assembly. The bridge is essentially flat and narrower at the top than at the bottom. The inner ends of the under supports 166, 167 end adjacent the bridge 169. The bridge 169 is a semi-rigid fabric, in an example. The bridge 169 acts to hold the cups 153, 154 laterally in place. The bridge 169 is rigid to such an extent that it does not allow the cups 153, 154 to move laterally relative to each other, yet allows the cups to move forward and rearward. As a result, the cups 153, 154 individually encapsulate the wearer's breasts prior to compression by the outer fabric cover 151 with the bridge 169 holding the two cups 153, 154 in place relative to each other.

Figure 5:
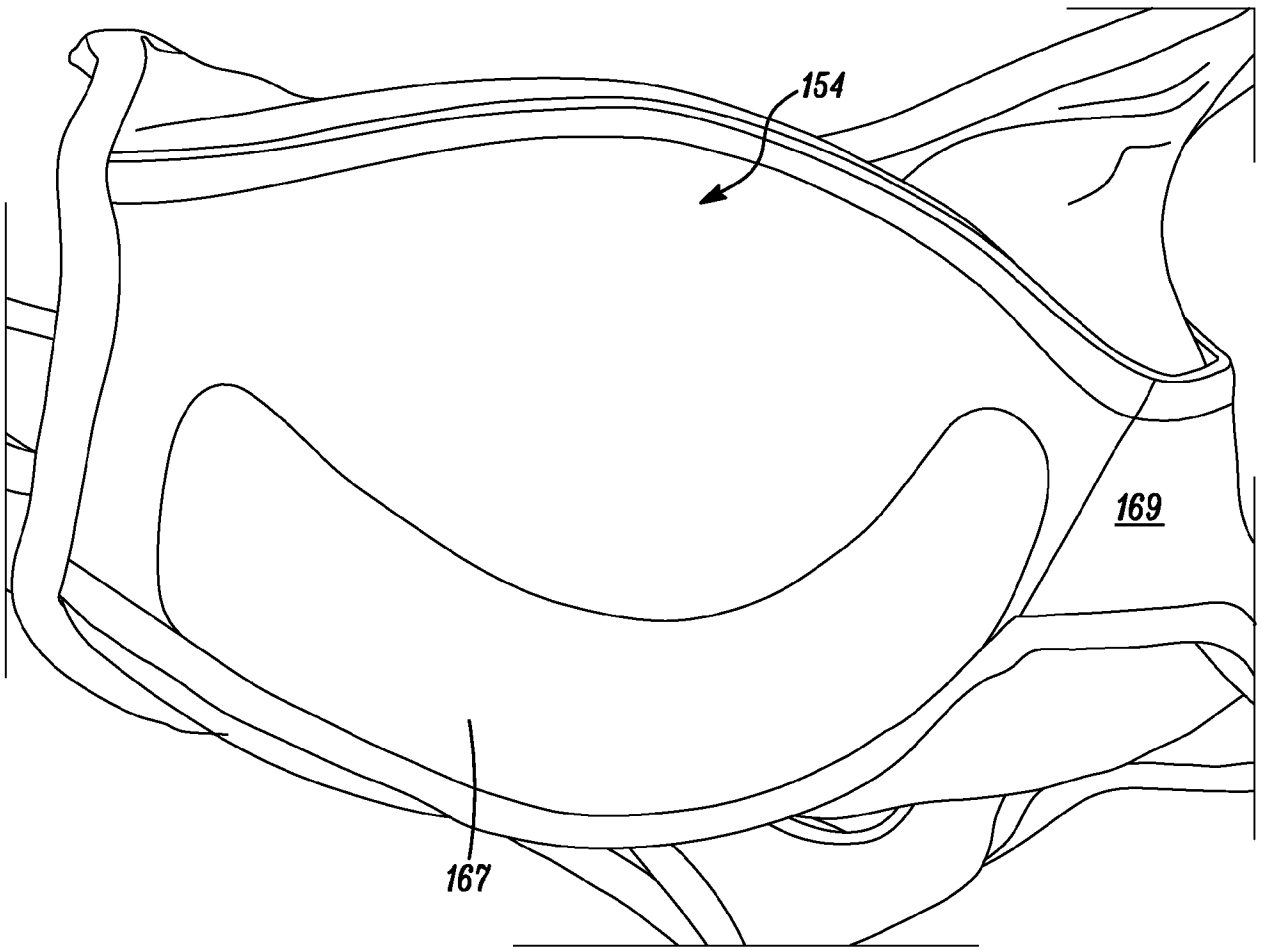
FIG. 5 is an enlarged, interior view of the exercise garment in accordance with an example embodiment.

FIG. 5 shows an enlarged view of the cup 154 with the under support 167 and the bridge 169. The cup 154 can help lift the breast therein by the under support 167 and encloses the breast tissue therein. The outer fabric cover can then compress against the cup 154, which is holding the breast. Traditional sports bras do not provide a cup that lifts, encapsulates, and then compresses the breasts as the present invention can.

Figure 6:
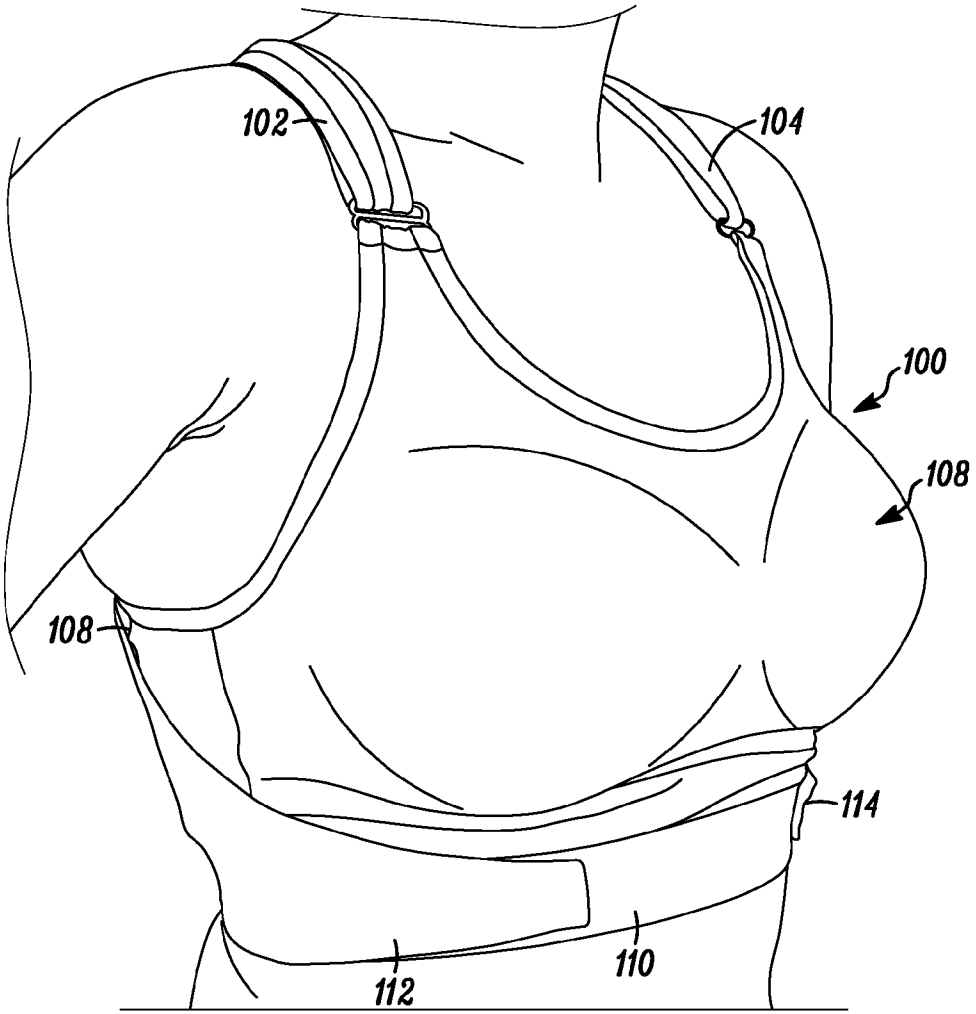
FIG. 6 is a view of the exercise garment being worn during use in accordance with an example embodiment.

FIG. 6 shows the exercise garment 100 being worn during use with the shoulder straps 102, 104 over the shoulders of the wearer with the wearer's breasts being held (lifted, encapsulated and then compressed) in the front panel 108. The side flaps 112, 114 assist in tightening the garment around the wearer's torso.

Figure 7:
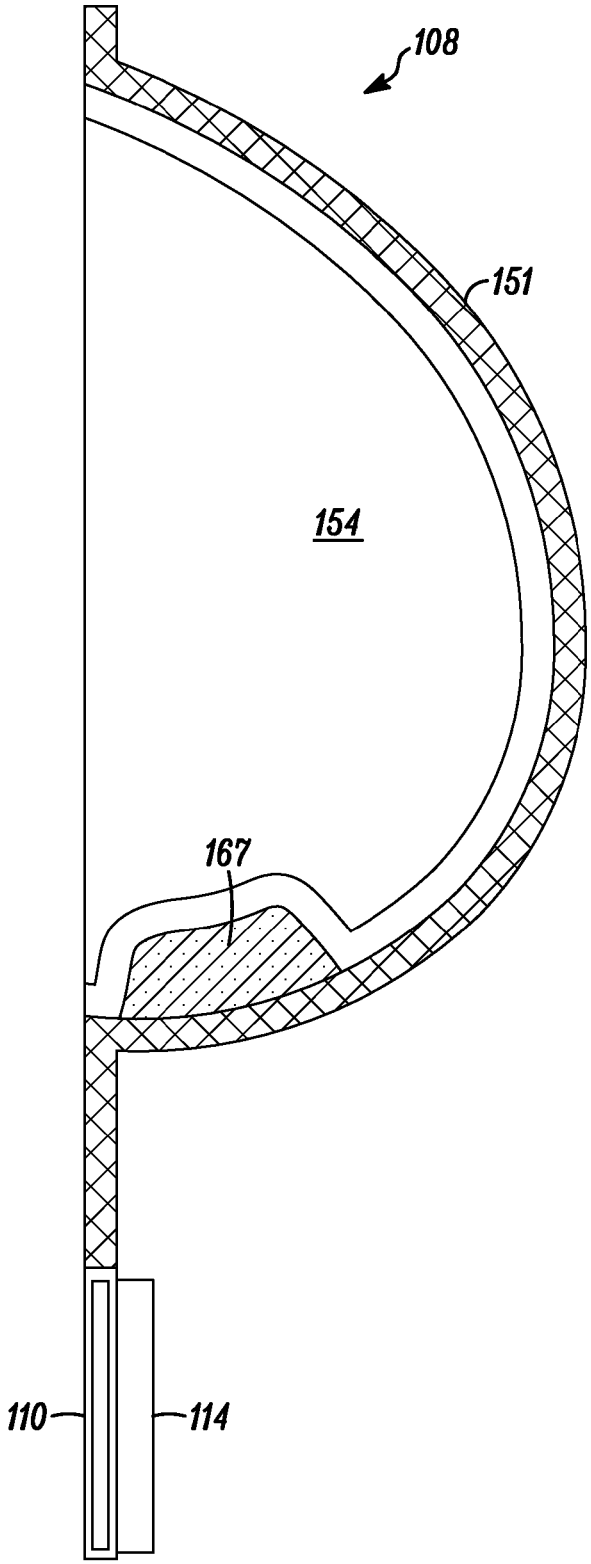
FIG. 7 is a cross-sectional view taken generally along line 7-7 of FIG. 1 in accordance with an example embodiment.

FIG. 7 is a cross-sectional view taken generally along line 7-7 of FIG. 1 of the garment 100. The front panel 108 includes the front cover 151 overlying the entire cup 154. The under support 167 is positioned between the cup material and the cover 151 material. The flap 114 is affixed to the band 110 beneath the cup 154.

Figure 8:
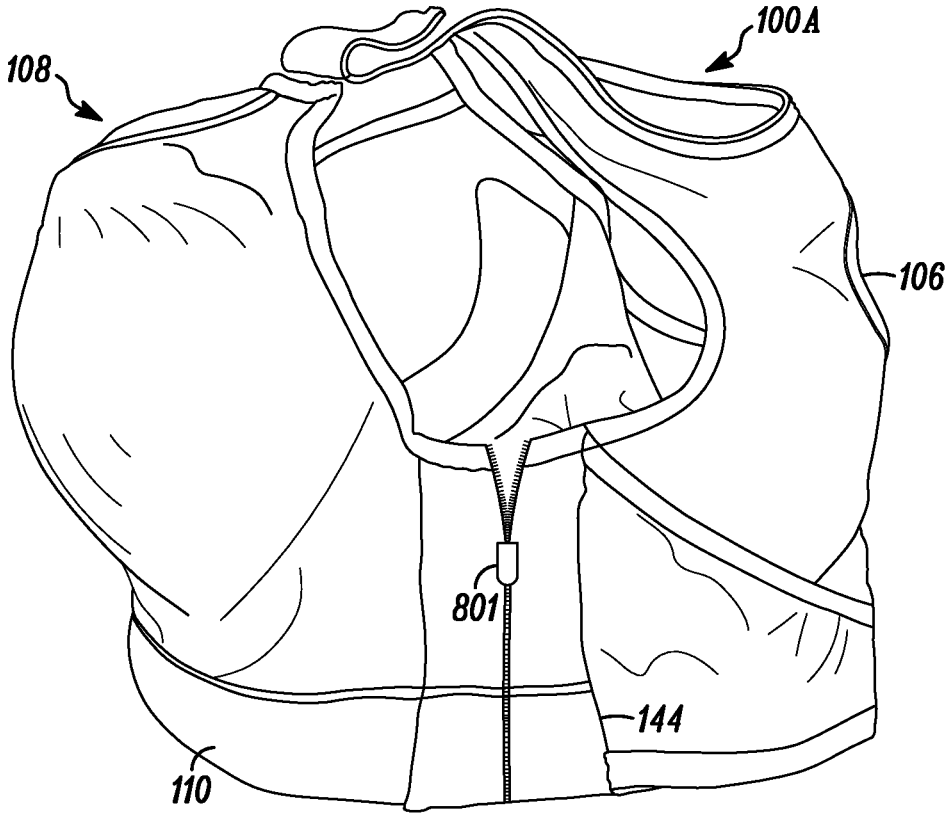
FIG. 8 is a side view of the exercise garment in accordance with an example embodiment.

FIG. 8 is a side views of a garment 100A similar to the side view of garment 100 described above. Garment 100A is similar to garment 100 in that it has a front panel 108 and a rear panel 106. Garment 100A includes a vertical closure 801 that releasably connects the front and rear panels 108, 106 together. In an example the closure 801 is a zipper. In other embodiment, the closure 801 can be a laced tie or hook and loop fastener. The closure 801 can extend the entire height of the side of the garment 100A.

Figure 9:
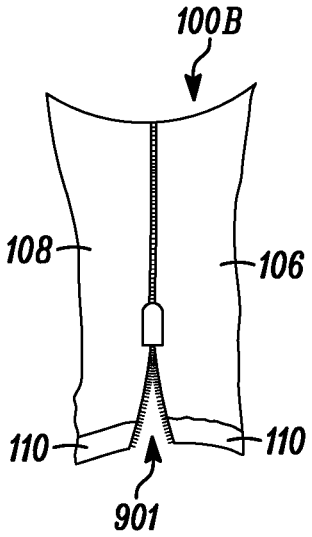
FIG. 9 is a further side view of the exercise garment in accordance with an example embodiment.

FIG. 9 shows a partial side view of a garment 100B where the closure 901 does not release the entire height of the garment side. The closure 901 releases from the bottom to release the tension on the garment such that the wearer can more easily disrobe. In an example, the bottom band 110 is elastic and expands about one inch to the torso circumference of the wearer for a snug fit. However, during exercise, the garment becomes wet with perspiration and may be difficult to remove. Here, the wearer releases the closure 801 to release the tension of the band or the body of the garment to make the garment easier to remove.

Figure 10:
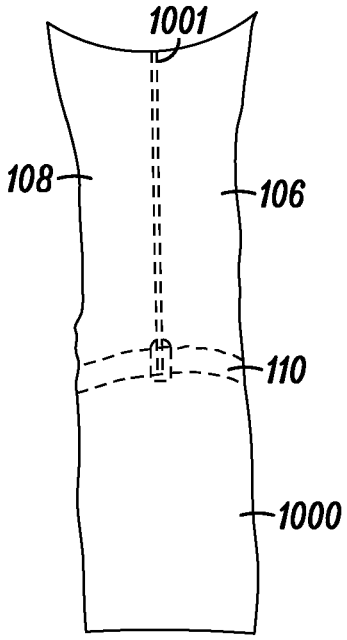
FIG. 10 is a side view of an exercise garment in accordance with an example embodiment.

FIG. 10 shows a partial side view of a garment 100C, which includes a shirt 1000 that can be connected to the front panel 108 and the rear panel 106. In an example, the shirt 1000 is constructed as a single fabric. Otherwise the front and rear panels 108, 106 can be the same as those described herein. The shirt 1000 extends downwardly from the band 110 to cover more of the wearer's torso. A closure device 1001 is provided to allow the garment 100C to be loosened and tightened on the wearer's body. For example, the closure 1001 is shown under the outer fabric. The closure acts to hold the front panel 108 and rear panel 106 in place to support the wearer's breasts. In an example, the closure device 1001 is a zipper defining a closed position with slider at the bottom beneath or at the band 110. In an example, the closed position of the device 1001 is at the top of the garment 100C. While shown as under the outer layer of the shirt 1000, it is within the scope of an embodiment to position the closure 1001 at the outside of the shirt 1000.

In an example, the front panel 108 includes a cup assembly (not shown in FIG. 10) as described herein. Other cup assemblies can be used with this shirt version of the present garment 100C. The cup assemblies for use with garment 100C can be a flexible, limp fabric that defines a cup as opposed to the semi-rigid, more supportive cup assembly 152 described above. This fabric cup assembly can be in two separate parts at each cup location. These separate parts are connected to the outer, compressive layer of the front panel 108. In an example, the fabric cup assembly is a wicking or mesh fabric.

Figure 11:
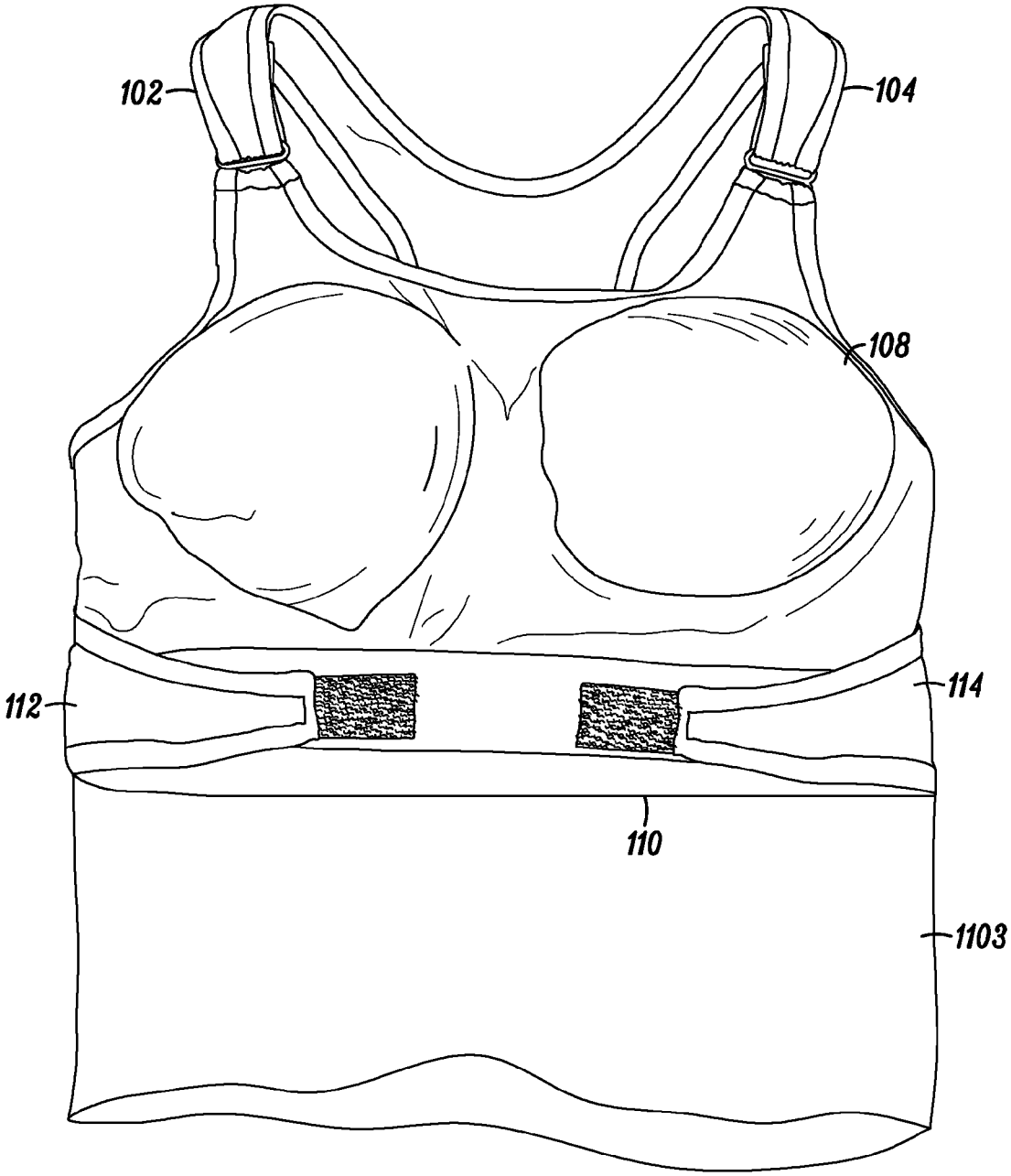
FIG. 11 is a front view of an exercise garment in accordance with an example embodiment.

FIG. 11 shows a front view of a garment 100D, which includes a shirt extension 1103 that extends downwardly from band 110 to cover more of the torso and the abdomen of the wearer. Garment 100D includes the front panel 108 and tightening flaps 112, 114 as described herein. The straps 102, 104 can also be the same as those described herein. This shirt garment 100D can further be modified to replace the flaps 112, 114 with the closures 801, 901, or 1001, which would operate as described herein.

In a further example, garment 100D can include the side closures 901, 1001 on the sides thereof. Adding the side closures 901, 1001 to the garment 100D provides additional ease of use, e.g., putting on and taking off the garment 100D.

Figure 12:
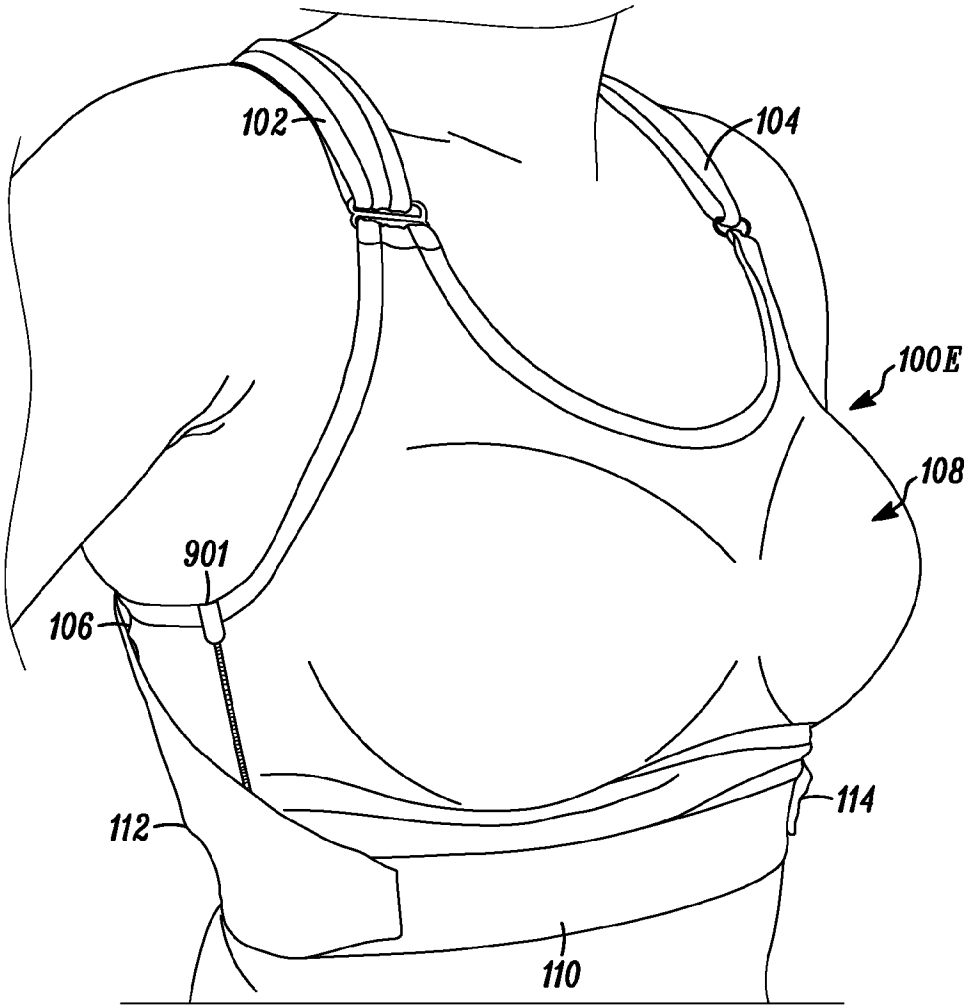
FIG. 12 is a view of the exercise garment being worn during use in accordance with an example embodiment.

FIG. 12 shows a view of the garment 100E that includes the same features as with regard to FIGS. 1-6 as well as a side closure 901, which can be the same as the closures shown in FIGS. 9-10. Closure 901 is shown in the closed position. If the closure 901 is opened, then the front panel 108 and the rear panel 106 on the side of the wearer can move apart from each other. This will ease the ability to take off and put on the garment 100E. In the illustrated example, the closure 901 is a zipper can extend beneath the flap 112. In an example, the closure 901 is only on one side of the garment 100E. In an example, a closure is on each side of the garment. The closure 901 can extend all the way through the garment 100E so that the front panel 108 and rear panel 106 are completely separated. The closure 901, in an example, only extends partway down the side of the garment. It will further be recognized that the closure 901 can be positioned as shown in FIG. 9 and closed when at the bottom of the garment 100E. When the closure is a zipper, it can have its slider under the flap when the garment is worn.

The rear panel 106, part of the front panel 108, straps 102, 104, flaps 112, 114, i.e., structures except for the cup assembly 152, of the garment can be constructed of at least one of stretchable polymer, woven fabric that provides both vertical and horizontal stretch. In an example, the fabric used for the garment can be up to ten percent spandex and the remainder polyester. In an example, spandex is eight percent. The percent can be measured by weight or by thread count. Examples of fabrics include COOLMAX™ material by Invista North America of Wilmington Del., DRYLAYER™ material by Russell Brands of Alexander City Ala., SUPPLEX™ or LYCRA™ material by Invista North America of Wilmington Del., all of which provides stretch, support, breathability for the skin and reinforcement of the garment 100. Moreover, the garment structures described herein can further be fabricated as multiple pieces that are then joined together to provide the structures described herein.

Rear panel 106 is described as a racer back construction. It will be recognized that other rear panel styles can be used in the present invention. In an example, the rear panel 106 can be a full back panel that extends to cover the back of the wearer, including over the scapulae of the wearer. In a further example, the rear panel 106 can have a profile that is substantially similar to the front panel as shown herein.

While many of the above examples describe hook and loop connectors in certain configurations where the hook part and the loop part are on the certain structures. It will be understood that the hook and loop parts could be reversed and positioned in the other structure. The hook and loop connector can be VELCRO™.

The present inventor has further determined that exercise bras must also have an attractive appearance and comfort for them to be accepted by women. The present garments can be made in varying chest and breast cup sizes while providing adequate support for women engaging in exercise and sports. It is known that exercise and sports can result in negative impact on the breast tissue if not adequately supported. The design of the present garment provides much greater comfort to the wearer's breasts than current sports bras. This increased comfort can result in the garment being worn longer than conventional sports bras, which can result in the wearer exercising for longer periods of time and more frequently as soreness due to inadequate support. The garment is individually adjustable in both vertical and horizontal directions to provide an individual fit for the wearer as women's bodies are all different. Moreover, if a woman loses weight over time or has gained weight, then the garment can be adjusted accordingly to continue to fit the woman properly.

The present inventor has unexpectedly recognized the need to improve women's exercise apparel by providing a garment that individually lifts a woman's breasts, individually encapsulates each breast in an individual cup, and then compresses the breasts to hold then in place while exercising. The present garment allows a woman to present a more natural looking profile while maintaining proper support. It is further believed that providing a natural profile will help the wearer look better and feel better about herself, and hence be more likely to exercise.

Some women today have a significant investment in breast reconstruction or augmentation. The present garment can protect these investments and help reduce the likelihood of addition corrective surgery by properly supporting the breast during exercise. It has been reported that a woman's breast can move up to 21 cm during exercise and hence it is important to properly support and restrict movement during exercise.

It will further be recognized that the garment can include pockets 198 (FIG. 2) to carry items, such as music players.

Thus, exercise garments, such as bras, support shirts, and tankinis, and methods of their use have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

The invention claimed is:

1. A brassiere, comprising:

a rear panel;

a front panel connected to the rear panel, the front panel including:

an elastic, outer cover fabric, a cup assembly including a first cup and a second cup to receive the breasts of the wearer, wherein each cup includes an under support that includes a foam material;

a semi-rigid bridge joining the first cup to the second cup, the bridge is to reduce lateral movement of the first cup relative to the second cup;

an elastic band beneath the cup assembly and operably connected to at least one of the front panel and the rear panel;

a first strap extending upwardly from the rear panel to the front panel;

a second strap extending upwardly from the rear panel to the front panel; and a circumferential tightening structure, operably connected to at least one of the rear panel and the front panel, to tighten the circumference of the garment around the torso of the user.

2. The brassiere of claim 1, wherein the first strap and the second strap are adjustable in length to position the front panel vertically.

3. The brassiere of claim 2, wherein the first and second straps are cantilevered from the rear panel and releasably connect to the front panel.

4. The brassiere of claim 3, wherein free ends of both the first strap and the second strap tuck through a connector and lie over a portion of the respective first strap and second strap and secure thereto.

5. The brassiere of claim 1, wherein the circumferential tightening structure includes at least one side flap that in a first, free position is connected to only one of the front panel and the rear panel and in a second, tensioning position has another end that connects to the other of the front panel and rear panel.

6. The brassiere of claim 5, wherein the at least one flap includes a right side flap and a left side flap.

7. The brassiere of claim 6, wherein the rear panel includes a height and wherein the right side flap and the left side flap are fixedly connected to the rear panel and extend essentially the height of the rear panel.

8. The brassiere of claim 7, wherein the right side flap and the left side flaps include a narrower end that is adapted to wrap around to the front panel and engage at least one of the front panel and the band to tension the garment around the torso of the wearer.

9. The brassiere of claim 8, wherein the band include a part of a hook and loop connector and the flaps include the other part of a hook and loop connector such that hook and loop connector releasably joins the flaps to a front of the band beneath the front panel.

10. The brassiere of claim 8, wherein the front panel and rear panel are integral with a shirt extension extending downwardly to cover a lower part of a torso of a wearer.

11. The brassiere of claim 1, wherein a connector joins the front panel to the rear panel along a side of a torso of a wearer.

12. The brassiere of claim 11, wherein the connector releases tension between the front panel and rear panel to assist in removing the garment from the wearer.

13. The brassiere of claim 1, wherein the cup assembly is essentially non-elastic and includes molded cups to match the breast size of the wearer.

14. The brassiere of claim 1, wherein the under support includes inner ends that end adjacent the bridge.

15. The brassiere of claim 1, wherein the cups encapsulate and compress breasts of the wearer.

16. The brassiere of claim 1, wherein the front panel and rear panel are integral with a shirt extension that extends downwardly past the elastic band to cover a lower part of a torso of a wearer.

17. The brassiere of claim 1, wherein the bridge includes a height less that the first cup or the second cup.

18. The brassiere of claim 1, wherein the bridge includes a top, a bottom and an essentially flat side, and wherein the top is narrower the bottom.

19. The brassiere of claim 1, wherein the bridge includes a semi-rigid fabric.

20. A brassiere, comprising:

a rear panel;

a front panel connected to the rear panel, the front panel including an elastic, outer cover fabric and an essentially inelastic cup assembly to receive the breasts of the wearer, the cup assembly including a left cup and a right cup joined by a bridge, wherein the bridge is to prevent lateral movement of the left cup relative to the right cup, wherein each cup includes an under support that includes a foam material;

a first strap extending upwardly from the rear panel to the front panel;

a second strap extending upwardly from the rear panel to the front panel, the first strap and second strap being adjustable to vertically position the cup assembly to receive the breasts of the wearer;

an elastic band beneath the cup assembly to extend around a torso of the wearer, the band including a loop part of a hook and loop connector on a front facing portion of the band;

a right side flap connected to a right side of the rear panel and extending essentially a height of the rear panel, the right side flap including a narrower end that includes the hook part of the hook and loop connector in an inward face of the right side flap, the narrower end to wrap around to the loop part on the band to connect thereto to adjust the right side size of the garment; and a left side flap connected to a left side of the rear panel and extending essentially a height of the rear panel, the left side flap including a narrower end that includes the hook part of the hook and loop connector in an inward face of the left side flap, the narrower end to wrap around to loop part on the band to adjust the left side size of the garment.

21. The brassiere of claim 20, wherein the rear panel is a racer back style.

22. The brassiere of claim 20, wherein a closure connects at least one side of the front panel to the rear panel, wherein the closure is closeable when the wearer is exercising and is adapted to be loosened to remove the brassiere.

23. The brassiere of claim 22, wherein the closure extends beneath one of the right side flap and the left side flap.

24. The brassiere of claim 23, wherein the closure separates the front panel from the rear panel to assist in removing the garment.

25. The brassiere of claim 24, wherein the bridge is semi-rigid to reduce lateral movement of the left cup and the right cup relative to each other.

26. The brassiere of claim 20, wherein the bridge is semi-rigid to reduce lateral movement of the left cup and the right cup relative to each other.

27. The brassiere of claim 20, wherein the right side flap and the left side flap are fixedly connected to the rear panel and extend essentially the height of the rear panel.

* * * * *